United States Patent [19]

Shea, Jr.

[11] Patent Number: 4,608,796

[45] **Date of Patent: * Sep. 2, 1986**

[54] MULTIPLE PANE GLASS UNIT

[75] Inventor: John R. Shea, Jr., Baltimore, Md.

[73] Assignee: Hordis Brothers, Inc., Pennsauken, N.J.

[ * ] Notice: The portion of the term of this patent subsequent to Aug. 14, 2001 has been disclaimed.

[21] Appl. No.: 623,386

[22] Filed: Jun. 22, 1984

[51] Int. Cl.[4] ..... E06B 3/24

[52] U.S. Cl. ..... 52/399; 52/304; 52/788

[58] Field of Search ..... 52/399, 397, 398, 403, 52/172, 304, 788

[56] References Cited

U.S. PATENT DOCUMENTS

| | | | |
|---|---|---|---|
| 2,342,758 | 2/1944 | Saunders et al. | 52/398 |
| 3,721,053 | 3/1973 | Geyser | 52/399 X |
| 3,722,161 | 3/1973 | Brown | 52/397 X |
| 3,900,966 | 8/1975 | Suarez | 52/399 |
| 4,266,487 | 5/1981 | Marulic et al. | 52/398 X |
| 4,464,874 | 8/1984 | Shea et al. | 52/398 |
| 4,471,584 | 9/1984 | Dietrich | 52/398 X |

*Primary Examiner*—J. Karl Bell

*Attorney, Agent, or Firm*—John F. A. Earley; John F. A. Earley, III

[57] ABSTRACT

A multiple pane glass unit for butt-glazing comprising an exterior glass sheet spaced apart from an interior glass sheet by horizontal head and sill spacers and a pair of vertical structural spacers, with the vertical spacers being constructed and arranged to provide structural support for the glass sheets against wind loads and the like and a first gasket strip mounted on a first vertical structural spacer, with a second, mating gasket strip mounted on a second vertical structural spacer, with the first and second gasket strips being arranged to contact one another along the vertical joints of side-abutting glass units to form a butt joint and being constructed and arranged to be substantially flush with the exterior glass sheets and to provide a weatherseal joint along the abutting vertical edges thereof, said gaskets being applied to the glass unit prior to installation and eliminating the need for an exterior applied wet weatherseal.

18 Claims, 10 Drawing Figures

MULTIPLE PANE GLASS UNIT

BACKGROUND OF THE INVENTION

1. Field of the Invention

This invention relates to multiple pane glass units, and more specifically to multiple pane glass units installed in a fashion known as "butt-glazed". Glass units of this type are installed in a building to achieve the appearance of a continuous band of glass around the building, or a long expanse of glass with minimal vertical joints.

2. Description of the Prior Art

Prior art glass units of the indicated type may require installation from the outside of the building and require the use of a temporary fastening means which must remain in place until the exterior wet weatherseal, which requires outside scaffolding to apply, has set properly. Then the temporary fastening means is removed. These prior art units also require a permanent upright stiffener on the inside of the building, and so are referred to as "flush-glazed" rather than "butt-glazed" which requires no inside stiffeners. Such stiffeners are not desirable because they tend to obscure the view from the inside of the building, to prohibit the placing of furniture close to the windows, and do not allow the appearance of a continuous glass ribbon (which is aesthetically desired).

Conventional multiple pane glass units are supported against wind load forces by clamping them into a window frame which supports the glass unit at the head, sill and sides. Such glass units are provided with relatively weak spacers between the panes of glass.

However, in typical flush-glazing, the vertical edges of the glass unit are not supported in a frame and support is given to the vertical edges of the glass unit by a stiffener mounted inside the building. To install the flush-glazed glass unit, it is conventional to clamp it in place by a temporary fastening means until the vertical structural adhesive applied to the vertical edges has cured.

Moreover, if a prior art flush-glazed glass unit breaks and has to be replaced, the replacement glass unit must be installed from the outside of the building in the same manner, and this presents a problem and is expensive.

In application Ser. No 439,064, filed Nov. 3, 1982, now U.S. Pat. No. 4,464,874, there is shown a multiple pane glass unit which may be installed easily from the interior or exterior of a building and which does not require a permanent upright stiffener on the inside of the building, nor does it require exteriorly applied weatherseal, nor does it require the utilization of a temporary fastening means to hold the glass unit in place while the structural adhesive joining the abutting units and structural support is curing.

SUMMARY OF THE INVENTION

It is the general object of this invention to provide an improved multiple pane glass unit to the type disclosed in said prior application Ser. No. 439,064 now U.S. Pat. No. 4,464,874.

The glass unit of the present invention may be installed easily from the interior or exterior of a building, does not require a permanent upright stiffener on the inside of the building, does not require exteriorly applied weatherseal, and does not require the utilization of a temporary means to hold the glass unit in place because structural adhesive joining abutting units is not used. The glass unit of the present invention is an improvement over the glass unit of said prior application in that it is less expensive to construct and is installed more easily and more efficiently, is provided with new snap-in extruded gaskets for exterior weatherseal, and has a new spacer design for easier sealing.

Another object of the invention is to provide a new, improved method of forming a butt-glazed joint between abutting glass units of the indicated type.

DETAILED DESCRIPTION

Figure 1:
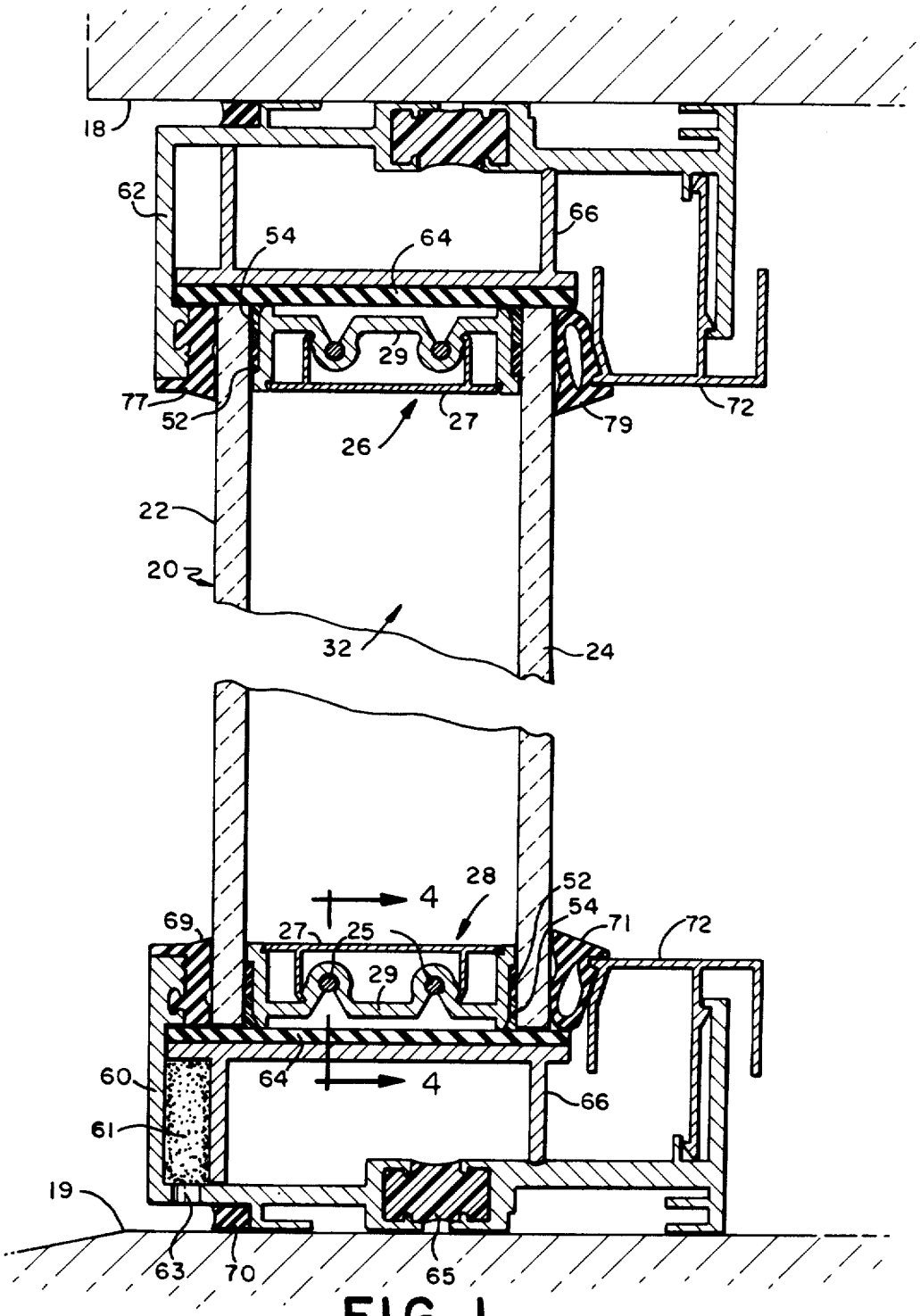
FIG. 1 is a view in vertical section of glass unit constructed in accordance with this invention.

Referring to FIGS. 1–4, there is shown a multiple pane insulating glass unit 20 which is rectangular and comprises an exterior glass sheet 22 spaced apart from an interior glass sheet 24.

A spacer means is positioned between connected to the horizontal and vertical edge portions of the glass sheets to maintain them in spaced apart relation.

The spacer means includes a head spacer 26 extending along the upper horizontal edge portions of the glass sheets 22 and 24 to space them apart and a sill spacer 28 extending along the bottom horizontal edge portions of the glass sheets 22 and 24 to space them apart. The construction of the horizontal spacers 26 and 28 is shown in detail in FIG. 1 and each comprises a cover 27 which is snap-fit onto a base 29 of extruded aluminum so as to provide a box-like construction.

Figure 4:
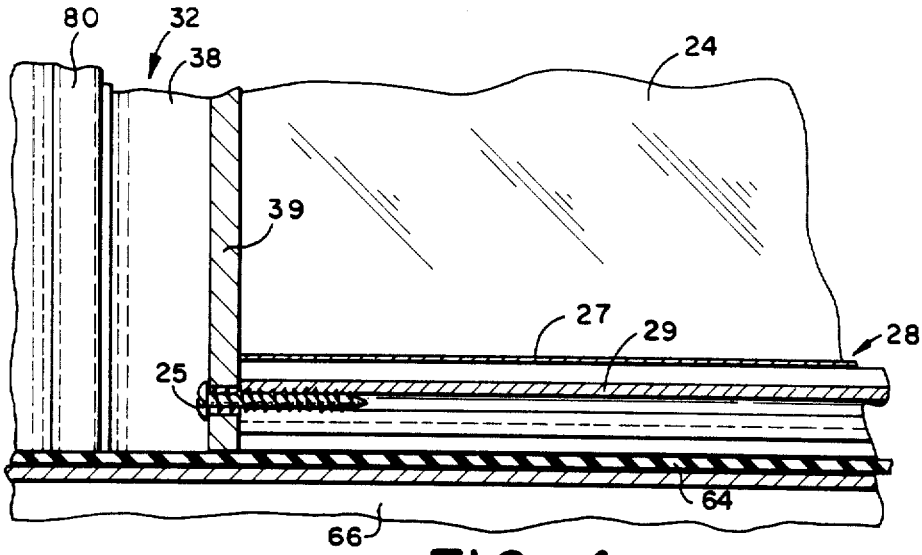
FIG. 4 is a sectional view taken on line 4—4 of FIG. 1.

The spacer means also includes a pair of vertical structural jamb spacers 30 and 32 extending vertically between head spacer 26 and sill spacer 28 along the vertical edge portions of the glass sheets 22 and 24. Vertical spacers 30 and 32 are connected to horizontal spacers 26 and 28 by screws 25 as shown in FIGS. 1 and 4. The construction is such that the vertical spacers 30 and 32 serve to space apart the glass sheets 22 and 24 along the vertical edge portions thereof and to provide structural support to the side portions of the glass sheets 22 and 24 to resist the pressures of wind and rain and the elements.

Figure 2:
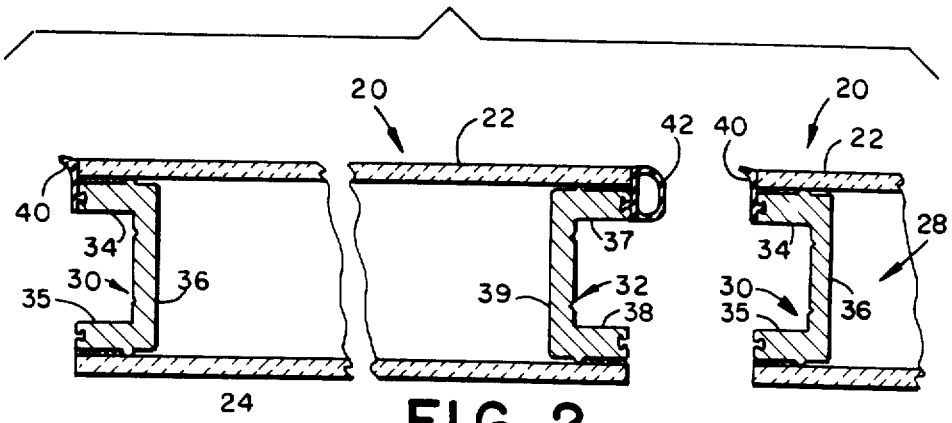
FIG. 2 is a view in horizontal section of a pair of glass units constructed in accordance with the invention.
Figure 3:
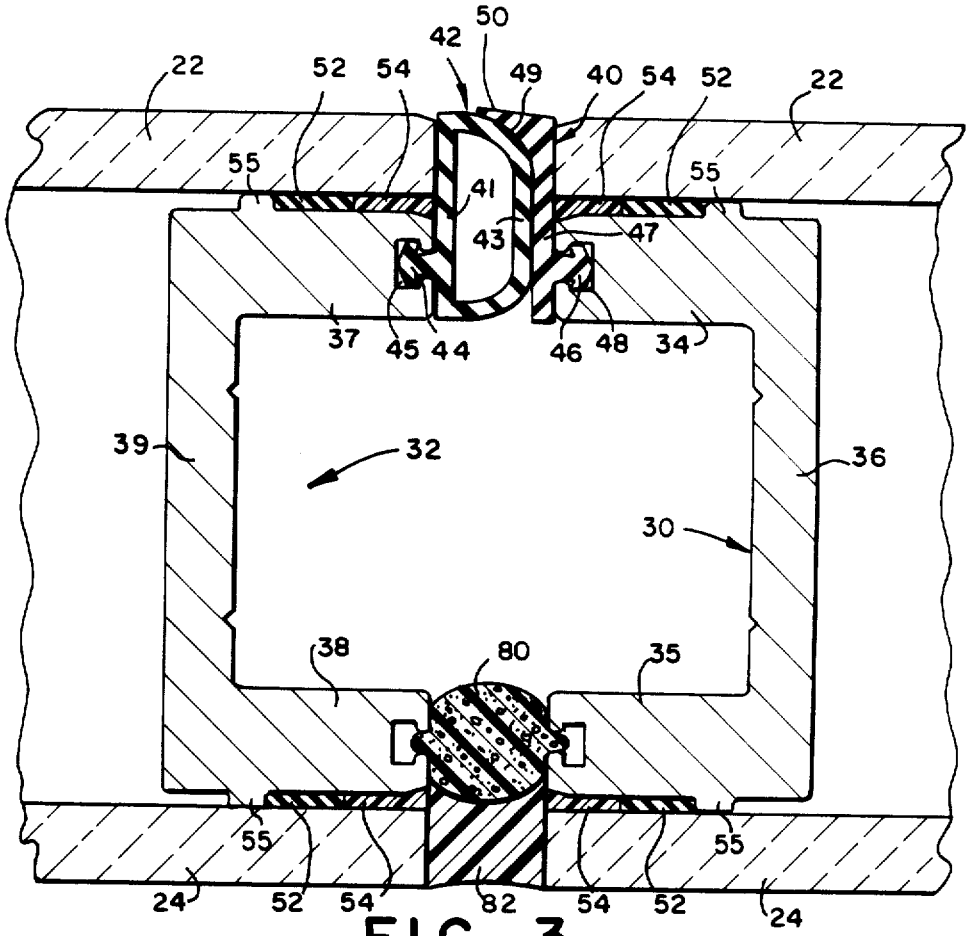
FIG. 3 is a fragmentary view in horizontal section showing the vertical joint between a pair of side-abutting glass units.

The vertical spacers 30 and 32 are constructed of a U-shaped aluminum channel as shown in FIGS. 2 and 3.

It is to be noted, however, that the terms "channel" and "channel-shaped" as used herein are intended to cover equivalent channel structures such as an I-beam shaped configuration, a box-shaped configuration, etc.

Spacer 30 includes a first leg portion 34 which has an end portion that is substantially flush with the vertical peripheral edge of the exterior glass sheet 22 and a second leg portion 35 which has an end portion that is substantially flush with the vertical peripheral edge of the interior glass sheet 24. Leg portions 34 and 35 are joined by a base portion 36 to provide the U-shaped channel configuration.

Spacer 32 includes a first leg portion 37 which has an end portion that is substantially flush with the vertical peripheral edge of the exterior glass sheet 22 and a second leg portion 38 which has an end portion that is substantially flush with the vertical peripheral edge of the interior glass sheet 24. Leg portions 37 and 38 are joined by a base portion 39 to provide the U-shaped channel configuration.

As is shown in FIG. 2, the spacers 30 and 32 are mounted substantially entirely within the interior of the spaced apart glass sheets 22 and 24.

Means are provided for sealing, as well as securing the leg portions 34, 35 and 37, 38 of each of the spacers 30 and 32 to the interior surfaces of the glass sheets 22 and 24. Such means comprises an inner layer 52 of a low moisture vapor transmission material, such as polyisobutylene, and an outer layer 54 of a structural adhesive such as silicone, polysulphide, polyurethane, such layers 52, 54 being located in the manner best shown in FIG. 3. The layers 52 and 54 extend around the perimeter of the glass sheets 22 and 24 and the spacers 30 and 32 therebetween, and cooperate with the bases 29 of horizontal spacers 26 and 28 as shown in FIG. 1. As shown in FIG. 3, leg portions 34, 35 and 36, 37 of the vertical spacers are provided with shoulders 55 which serve to dress up the line of the butyl layer 52, and to provide a gap between the glass and metal for putting in the sealant.

In accordance with a novel feature of the invention, seal means are attached to the vertically extending end portions of the exterior or first leg portions 34 and 37 of the spacers 30 and 32 for sealing the vertical joint between installed side-abutting glass units as shown in FIG. 3.

In the embodiment of the invention shown in FIGS. 1–4, the seal means comprises a pair of gaskets 40, 42 of extruded silicone or like material mounted to mate in a sealing contact to minimize water passage. Gasket strip 40 is mounted on first leg portion 34 of spacer 30 and the other gasket strip 42 is mounted on first leg portion 37 of spacer 32.

Gasket strip 42 has a tubular configuration and comprises a straight wall 41 and a curved wall 43 to provide a generally D-shaped cross-section. The straight wall 43 is provided with a rib-like key or dart 44 projecting therefrom and received in a dart groove or slot 45 in the end portion of first leg portion 37 of spacer 32.

Gasket strip 40 is solid and has a straight wall portion 47 joined with a flared portion 49. The straight wall portion 47 is provided with a rib-like key or dart 46 projecting therefrom and received in a groove or slot 48 in the end portion of first leg portion 37 of spacer 30 as is shown in FIG. 3. The gasket strips 40 and 42 are constructed and arranged so that when two glass units 20 are assembled in side-abutting relationship to form a butt-glazed joint, the gasket strips 40 and 42 compress to form a seal extending along the adjacent vertical edges of abutting exterior glass sheets 22. Moreover, the parts are constructed and arranged so that the gasket strips 40 and 42 are substantially flush with the outer surfaces of the exterior glass sheets 22 in the assembled condition as shown in FIG. 3 to provide an exterior appearance of a continuous unbroken expanse of glass. As shown in FIG. 3, the outer wall 50 of the flared portion 49 extends substantially along the plane of the outer surfaces of the adjacent exterior glass sheets 22. The hollow D-shape of gasket strip 42 provides a convex exterior surface which is similar in curvature to the surface of gasket strip 42 so the gasket strips 40 and 42 mate together in a compressed sealing contact as is shown in FIG. 3.

The above-described gasketing arrangement permits the installation of the glass units 20 from the inside of the building, though they could be installed from the outside of the building if desired.

FIG. 1 illustrates the manner in which a glass unit 20 is mounted in an opening 18 in a building outer wall 19.

Thus, glass unit 20 is supported to extend vertically between a sill frame 60 and a head frame 62. As installed, the bottom edge of the glass unit 20 rests on a setting pad 64, which may be made of vinyl rubber, neoprene, or silicone, on an extruded aluminum setting chair or saddle 66. Saddle 66 could be a one-piece rubber-like chair plus pad, such as of neoprene or silicone. Setting chair 66 is supported on the horizontal portion of the sill frame 60 as shown in FIG. 1. A weather seal, outer sill gasket 69, is positioned between the exterior glass sheet 22 and sill frame 60, and a foam baffle or air stop 61 is positioned just above a weep slot 63 so as to permit water to drain out of the glass unit 20 while preventing whistling or the entry of insects.

A thermal barrier 65 is provided in the horizontal portion of sill frame 60, and sill frame 60 is attached by screws, bolts or other fasteners (not shown) to the bottom wall of the building opening 18. A weatherseal 70 is provided between the sill frame 60 and the building opening as shown in FIG. 1.

A wedge or roll-in gasket 71 is positioned between interior glass sheet 24 and a glazing bead 72 mounted at the interior end of the sill frame 60 and serves to push the glass unit 20 against outer sill gasket 69.

Head and sill spacers 26 and 28 provide space internally for dessicant which is positioned in either one or both to remove water vapor that exists in the air space when the unit is built or that may penetrate the sealed air space between the glass sheets 22 and 24 after the unit is built. Each of the spacers 26 and 28 comprises a cover 27 which snaps into a base 29 that is constructed to provide horizontal spaces between the glass sheets 22 and 24 and the side legs of base 29, such spaces being filled with seal layer 52 and adhesive layer 54 during the manufacture of the unit 20.

The upper edge portions of glass unit 20 are supported, by head frame 62 and a glazing bead 72, between an outer gasket seal 77 and a rollin gasket 79 as is shown in FIG. 1.

Referring to FIG. 3, a foam backer rod 80 is positioned in compression between the ends of the second leg portions 35 and 38 of the vertical spacers 30 and 32 of abutting units 20 to close the vertical space therebetween. A seal joint 82 of silicone or other sealant fills the space between the vertical edges of the interior glass sheets 24 of abutting glass units 20 as is shown in FIG. 3.

The horizontal and vertical spacers 26, 28, 30, 32 described above are preferably made of aluminum or stainless steel and, may be approximately two inches wide to provide a two inch air space between the glass sheets 22 and 24.

The method of installing a plurality of glass units 20 in side-by-side relation to form a butt-glazed systems will now be described. While typically a butt-glazed system would start with the formation of a corner, the description will be directed to an installation wherein one glass unit 20 has already been installed and will describe the method by which a second glass unit 20 is installed in a "straight run" or "in line" with the previously installed glass unit 20. Referring to FIG. 2, it is to be understood that the glass unit 20 on the right has been installed previously.

Preparatory to installation of the glass units 20, the sill frame 60 and head frame 62 are installed and fastened by screws to the horizontal surfaces of the opening 18 of the building. Also, these frames 60 and 62 are leveled and the outer sill gasket 69 is installed at the bottom and gasket 77 is installed at the top to provide a cushion at the front of the glass units 20. Gaskets 69 and 77 are made of a soft, spongy material, such as sponge neoprene rubber. Also the reticulated foam baffles 61 and weep holes 63 are provided and the setting chair 66 and setting pad 64 are installed and set in the position as shown in FIG. 1. The above steps prepare the installation for the insertion of the glass units.

The glass unit, which has been factory-assembled with the horizontal and vertical spacers 26, 28, 30, 32 sealed and secured between the exterior glass sheet 22 and the interior glass sheet 24 is brought to the job site. The male and female gasket strips 40 and 42 are mounted on the opposite vertical edges of the glass unit 20 by snapping their darts 46 and 44 into the associated dart grooves 48 and 45 in the ends of the leg members 34 and 37 of the vertical spacers 30 and 32, as shown in FIG. 2. If desired, gasket strips 40 and 42 may be inserted in dart grooves 48 and 45 at the factory. Then glass unit 20 is set onto the setting pad 64 and moved toward the previously installed glass unit 20 so as to compress the male and female gasket strips 42 and 40 together to form an essentially watertight vertical seal.

Next, a glazing bead 72 is assembled into sill frame 60 from the interior of the building and then the roll-in gasket 71 is installed to secure the bottom of the glass unit 20 in place. Then a glazing bead 72 and the roll-in gasket 79 are positioned in place at the head frame 62 to secure the top of the glass unit in place within the head frame 62.

The assembly is such that the glass unit 20 is held in compression between the outer sill gaskets 69 and 77 and the roll-in gaskets 71 and 79 at the top and bottom.

After the two units have been positioned in place as described above and shown in FIG. 3, the foam backer rod 80 is pushed in place between the opposed leg, portions 35 and 38 of the spacers 30 and 32 as shown in FIG. 3.

Finally, a seal 82 is applied by way of an extrusion gun or the like to the vertical space formed between opposed vertical edges of the interior glass sheets 24 so as to seal off the interior part of the joint. This serves to provide a vertical seal between the opposed vertical edges of the interior glass sheets 24 of adjacent glass units 20. A cover plate may be positioned over the interior joint.

It will be evident that the entire method described above can be performed from the inside of the building. There is no need, as in prior art methods, to apply a wet weather seal from the exterior of the building to seal the joint between exterior glass sheets of adjacent glass units.

Figure 6:
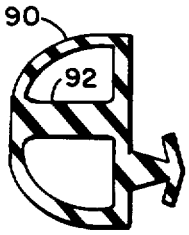
FIG. 6 is a detail view showing an alternative gasket construction in accordance with the invention.

In FIG. 6 there is shown a gasket strip 90 which is an alternative to the gasket strip 42 shown in FIGS. 1–4. Gasket strip 90 has an interior rib 92 that divides gasket 90 into two hollow portions as shown in FIG. 6. This construction of the gasket strip 90 increases its compressive strength.

Figure 5:
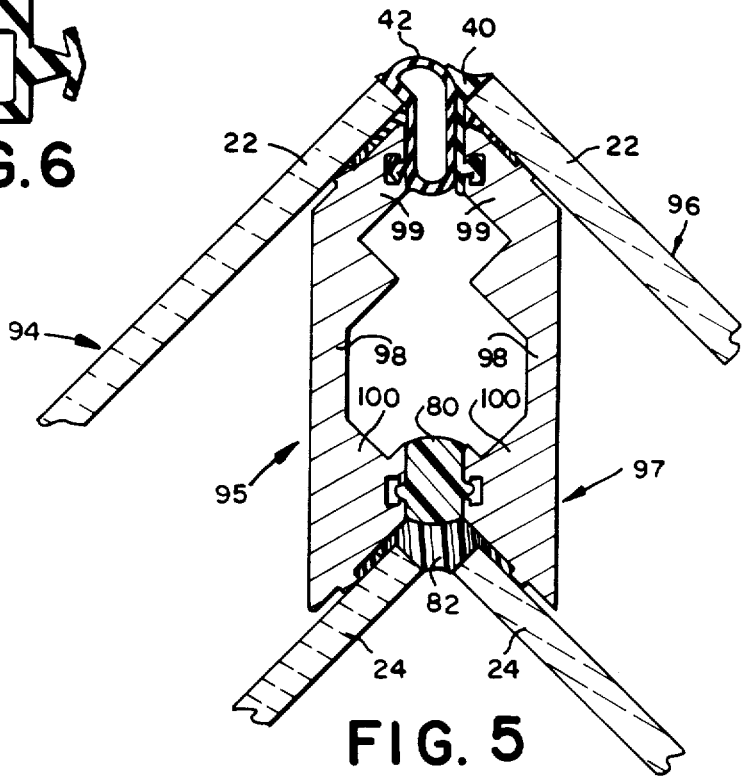
FIG. 5 is a view in horizontal section showing abutting glass units at a 90° corner.

In FIG. 5 there is shown a joint for a pair of corner units 94 and 96 which abut at a 90° corner. Glass units 94 and 96 are essentially the same as glass unit 20 except that the exterior glass panes 22 are wider than the interior glass panes 24, and special vertical spacers 95, 97 are provided along the vertical edge thereof where the corner is to be formed. Vertical spacers 95 and 97 made of channels having a cross-section as shown in FIG. 5, with each of the spacers 95 and 97 comprising a base portion 98 extending between the spaced-apart glass sheets 22 and 24 of the associated glass unit and a pair of spaced apart leg portions 99 and 100 extending at a 45° angle to the base portion 98. By this construction, as shown in FIG. 5, leg portions 99 of spacers 95 and 97 extend along the inwardly facing wall of the exterior glass sheets 22 of glass units 94 and 96 and leg portions 100 of spacers 95 and 97 extend along the inwardly facing wall of the glass sheets 24 of glass units 94 and 96. Leg portion 99 of spacer 95 is provided with a dart groove to receive a gasket 42 and leg portion 99 of spacer 97 is provided with a dart groove to receive a gasket 40. Gaskets 40 and 42 mate in compression to provide a watertight seal at the exterior edge portion of the corner joint. The interior corner is sealed in the same manner as the straight run glass units 20 as shown in FIG. 3 by the use of a backer rod 80 and sealant 82.

Figure 7:
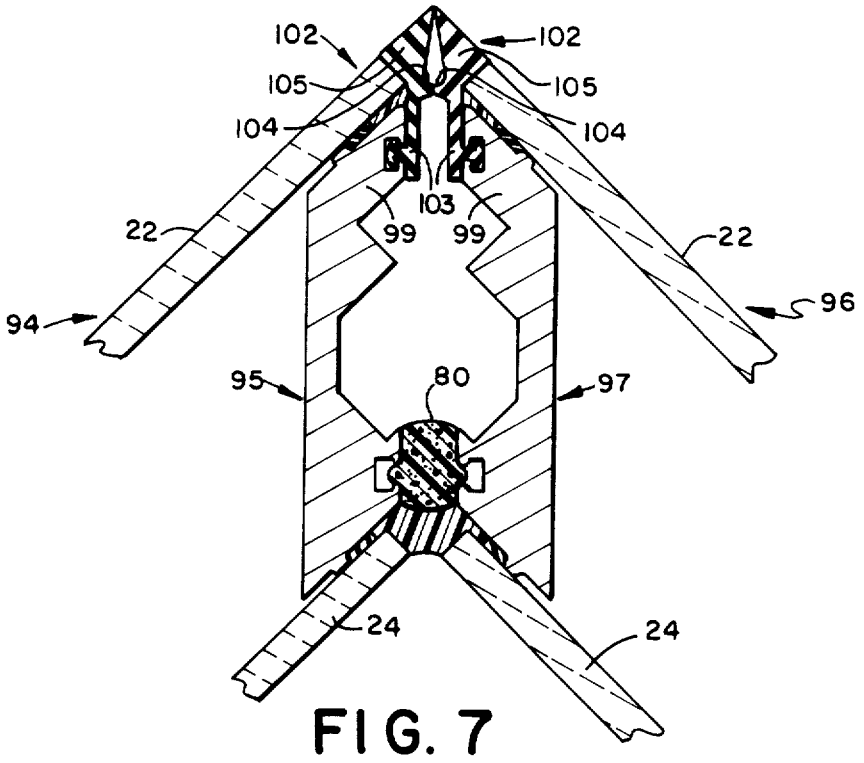
FIG. 7 is a view in horizontal section of another type of gasket means used for abutting glass units at a 90° corner.

In FIG. 7 there is shown a 90° corner joint identical with that shown in FIG. 5 except different gasket strips are mounted in the dart grooves of the leg portions 99 of the spacers 95 and 97. Each of these gasket strips is indicated generally at 102 and comprises a straight portion 103 having a dart rib extending therefrom for seating in the dart grooves of leg portions 99. The straight portion 103 is joined by a projecting rib 104 at a medial portion of the gasket strip 102. Beyond the rib portion 104 there is formed a triangular portion 105 having approximately the cross-section of a right triangle. By this construction, when the corner joint is formed, one leg of the right triangular portion 105 is contacted by the vertical edge of the exterior sheet 22 of the associated glass unit 94, 96 and the other leg of the right triangular portion 105 extends along the line of the outwardly facing surface of the exterior glass sheets 22 to form a sharp right angular corner as shown in FIG. 7. The rib portions 104 are forced into contact to provide a vertically extending seal at the exterior portion of the 90° joint.

Figure 8:
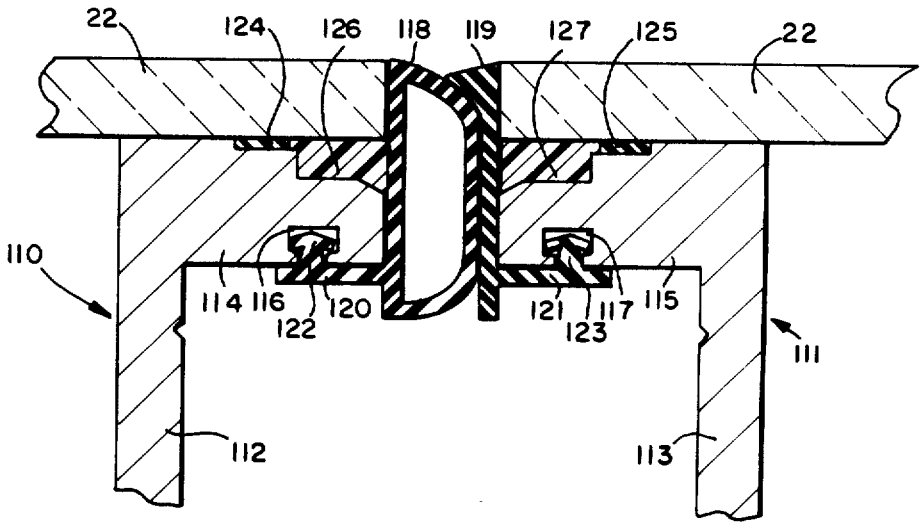
FIG. 8 is a view in horizontal section showing an alternative type of vertical spacer construction and an alternative type of sealing gasket means therefor.

In FIG. 8 there is shown another construction of the vertical spacers and the gaskets associated therewith. The vertical spacers 110 and 111 of this embodiment are similar to the spacers 30 and 32 of FIGS. 1–4. In the FIG. 8 embodiment, the vertical spacers 110 comprise a U-shaped channel having a base 112 and a pair of identical leg portions, only one leg portion 114 being shown in FIG. 8. Spacer 110 is provided with a dart hole 116 which, as contrasted with the prior construction, is located in the inwardly facing wall of leg portion 114. In a like manner, the other vertical edge of the glass unit is provided with a U-shaped spacer 111 having a base 113 and a leg portion 115 with a dart hole 117 located in the inwardly facing wall thereof.

In order to accommodate the change in the location of the dart holes 116 and 117, there are provided gasket strips 118 and 119 which are provided with leg portions 120 and 121 extending along the inner wall of leg portions 114 and 115, respectively. Leg portions 120 and 121 are provided with darts 122 and 123 and adapted to be received in the dart grooves 116 and 117. As shown in FIG. 8, gasket strips 118 and 119 mate in compression to form the exterior weatherseal of abutting units in the same manner as described above with respect to FIGS. 1–4.

One advantage to the location of the dart grooves 116 and 117 on the inside wall of the leg portions 114 and 115 of the spacers 110 and 111 as shown in FIG. 8 is that this location is out of the way so as to be safe from the entry of the sealant material applied to the space between spacers and the glass sheets during the fabrication of the glass units. In the arrangement shown in FIGS. 1–4 the application of the sealant 54 during the last stages of fabrication of the glass units 20 is such that it is possible for the sealant material to drip along the end portion of the spacer leg portions 34, 37 and enter the dart grooves 48, 45 formed therein which would then have to be cleaned. However, this is not possible with the location of the dart grooves 116, 117 as shown in FIG. 8.

Another advantage of the dart groove arrangement of FIG. 8 is that it provides a better, more forgiving anchor for the gasket strips. With the arrangements shown in FIGS. 1–4, an oversized exterior glass sheet might tend to urge a gasket strip away from the end of the leg portion and out of the associated dart groove. The anchor arrangement provided by the dart grooves 116 and 117 tends to obviate this problem.

Another major change in the construction of the spacers 110 and 111 is that the leg portions 114 and 115 are provided with enlarged relief portions on their outer wall adjacent the glass sheets 22 so as to permit the application of the adhesive sealant between the outer wall of the leg portions 114 and 115 and the adjacent surface of the glass sheets 22 in an easier fashion.

To this end, the outer walls of the leg portions 114 and 115 are provided with a stepped cut-away portions 124, 126 and 125, 127, respectively, as shown in detail in FIG. 8. The sealant layer is applied to the inner step portions 124 and 125 and the adhesive is then applied into the second step portions 126 and 127 to fill the space between the outer walls of leg portions 114 and 115 and the adjacent surfaces of the glass sheets 22.

Figure 9:
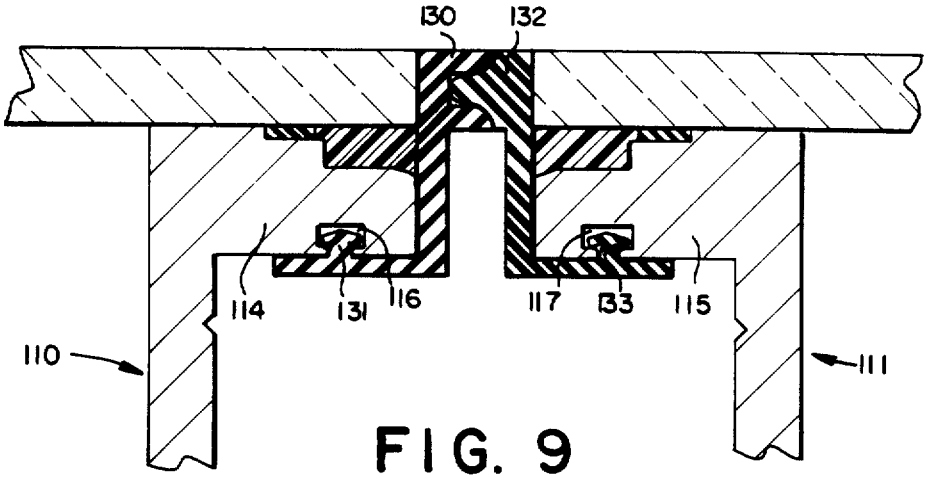
FIG. 9 is a view in horizontal section showing another type of gasket construction for use with the vertical spacer shown in FIG. 8.

In FIG. 9 there is shown a vertical spacer construction indentical to that shown in FIG. 8 with the exception that different types of gasket strips are utilized. In the embodiment shown in FIG. 9, a female gasket member 130 is mounted on leg portion 114 of spacer 110 with its dart 131 inserted into dart groove 116, and a male gasket strip 132 is mounted on leg portion 115 of spacer 111 with its dart 133 seated in dart groove 117. The gasket strips 130 and 132 have cooperating female and male portions which achieve a weather-tight seal by an interlocking cooperation of the gasket strips 130 and 132.

Figure 10:
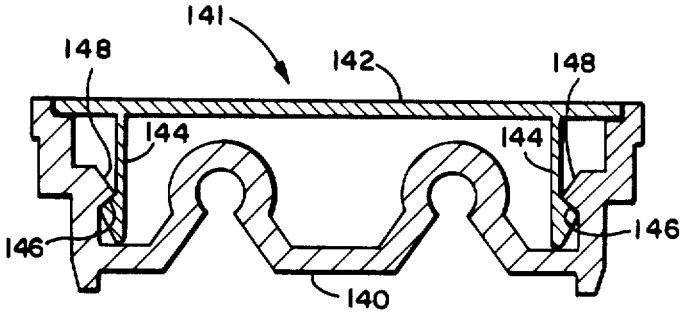
FIG. 10 is a sectional view showing another type of horizontal spacer construction.

In FIG. 10 there is shown an alternative type of horizontal spacer construction. In this embodiment, the base 140 of the horizontal spacer 141 is provided with the stepped cut-away portions similar to that provided in the embodiment shown in FIG. 8 in order to permit the ease of delivery of the sealant as described above. In addition, the cover 142 of the horizontal spacer 141 has a pair of leg portions 144 projecting shoulder portions 148 on the base 140. The tip portions 146 and cooperating shoulder portions 148 are formed with inclined camming surfaces as shown in FIG. 10. By this arrangement, when the cover 142 is snapped into the assembled position on base 140, the cooperating camming surfaces cause the legs 144 to bend inwardly gradually and uniformly so as to ensure the accurate attachment of the cover 142 onto the base 140 in the assembled position shown in FIG. 10.

Advantages

Butt-glazing has considerable appeal to the designer who can now achieve the appearance of continuous band of glass around his building, even around inside or outside corners. Glass no longer needs to look like a series of separate windows. The present invention accomplishes this aesthetic effect not only for the exterior of the building but also for its interior. The inventive glass units provide their own vertical support for the glass and make any vertical support columns inside the building unnecessary. This gives the designer a smooth, continuous expanse of glass on the inside of the building as well as on the outside. Appealing aesthetics are one major benefit gain. Another is the simplicity of initial installation and replacement with resultant cost saving.

I claim:

1. A multiple pane glass unit comprising an exterior glass sheet having spaced-apart horizontal and vertical edge portions an interior glass sheet having horizontal and vertical edge portions aligned with said horizontal and vertical edge portions of said portions of said exterior glass sheet, a horizontal head spacer located between aligned horizontal edge portions of said exterior and interior glass sheets, a horizontal sill spacer positioned between aligned horizontal edge portions of said glass sheets, a pair of vertical spacers positioned between aligned vertical edge portions of said exterior and interior glass sheets, said horizontal and vertical spacers being interconnected at their ends and being secured to the glass sheets at the edge portions thereof for spacing said glass sheets apart, said vertical spacers being constructed and arranged to provide structural support for the glass sheets against wind loads or the like, said vertical spacers including a first channel member extending along one pair of aligned vertical edge portions of the glass sheets and a second channel member extending along the other pair of aligned vertical edge portions of the glass sheets, said first channel member including a first leg portion which extends along the vertical edge portion of the associated exterior glass sheet and a second leg portion which extends along the vertical edge portion of the associated interior glass sheet, said second channel member including a first leg portion which extends along the vertical edge portion of said associated exterior glass sheet and a second leg portion which extends along the vertical edge portion of said associated interior glass sheet, said first and second channel members being mounted substantially entirely within the .interior of the spaced-apart glass sheets, and gasket means attached to said first leg portions of said first and second channel members for use in sealing the exterior vertical joint between adjacent glass units on installation thereof in abutting relation, said gasket means including a first gasket strip mounted on the first leg portion of said first channel member and a second gasket strip mounted on the first leg portion of the second channel member, said first and second gasket strips being arranged to contact one another along the vertical joints of side-abutting glass units to form a butt joint and being constructed and arranged to be substantially flush with the exterior glass sheets and to provide a weather-seal joint along the abutting vertical edges thereof.

2. The unit of claim 1 wherein said first gasket has a hollow tubular construction and provides a convex exterior surface, and said second gasket strip comprises a solid strip which provides a concave exterior surface similar in curvature to that of the first gasket strip so that the first and second gasket strips mate together to form said weather-seal joint.

3. The unit according to claim 1 including means for sealing the adjacent vertical edges of the interior glass sheets of side-abutting glass units including a foam backer rod compressed between the second leg portions of said channel members in the installed side-abutting position of adjacent units.

4. The unit according to claim 3 wherein said means for sealing the adjacent vertical edges of the interior glass sheets includes a sealant filling the space between the vertical edges of the interior glass sheets of adjacent units.

5. The unit according to claim 1 wherein said vertical spacers are made of a sturdy metal construction and said gasket strips are made of a resilient material.

6. The unit according to claim 2 wherein said first gasket strip has a generally D-shaped cross-section and includes an interior rib which divides the interior thereof into two hollow portions.

7. The unit according to claim 1 wherein said first leg portions of said first and second channel members are provided with vertically extending key slots and each of said gasket strips is provided with a dart-shaped key adapted to be received and held in said key slots.

8. The unit according to claim 1 wherein one of said channel members is adapted for use at a corner joint, said channel member comprising a base portion extending between the spaced-apart glass sheets and spaced-apart first and second leg portions extending at an angle to the base portion.

9. The unit according to claim 8 wherein said angle at which said spaced-apart leg portions extend to said base portion is 45° whereby said channel member is adapted for forming a 90° corner.

10. A unit according to claim 9 wherein said first gasket strip which is mounted on said first leg portion of said one channel member comprises a straight portion having a dart key extending therefrom for receipt in a dart groove in said first leg portion, a projecting rib at a medial portion, and a triangular portion adjacent said rib portion having approximately the cross-section of a right triangle.

11. The unit according to claim 1 wherein said first and second channel members are U-shaped with said first and second leg portions extending at right angles with a base portion extending between the exterior and interior glass sheet.

12. The unit according to claim 11 wherein said first leg portion of said first and second channel members is provided with vertically extending grooves located to extend into the inwardly facing wall thereof, said gasket strips being provided with dart keys which are adapted to be received in said dart grooves.

13. The unit according to claim 11 wherein said first and second leg portions are provided with enlarged relief portions on their outer walls adjacent the inwardly facing surfaces of the glass sheets so as to provide a large space for the application of sealant.

14. The unit according to claim 12 wherein said enlarged relief portions are formed by stepped cut-away portions.

15. The unit according to claim 1 wherein said first gasket strip is a female member and said second gasket strip is a male member adapted to interlock with said female member to form an interlocking weatherseal joint.

16. The unit according to claim 1 wherein at least one of said horizontal spacers is comprised of a base portion and a cover portion snapped onto the base portion to form a box-like configuration, said cover having a pair of leg portions projecting from a straight wall portion thereof and provided with a projecting tip portion adapted to engage shoulder portions on said base, said tip portions and cooperating shoulder portions being formed with inclined camming surfaces so as to cause the legs to bend gradually and uniformly as the cover is snapped onto the base portion.

17. The method of installing a plurality of multiple pane glass units in a vertically extending opening in a building or the like in side-abutting relation to form a butt-glazed joint, wherein each glass unit is comprised of exterior and interior glass sheets with a pair of horizontal spacer members located between aligned horizontal edge portions of said glass sheets and a pair of vertical spacers positioned between aligned vertical edge portions of said glass sheets, said horizontal and vertical spacers being interconnected at their ends and secured to the glass sheets for maintaining the glass sheets in spaced-apart relation, one of said vertical spacers including a first channel member extending along one pair of aligned vertical edge portions of the glass sheets and the other vertical spaces including a second channel member extending along the other pair of aligned vertical edge portions of the glass sheets, said first channel member including a first leg portion which extends along the vertical edge portion of the associated exterior glass sheet and a second leg portion which extends along the vertical edge portion of the associated interior sheet, and said second channel member including a first leg portion which extends along the vertical edge portion of said associated exterior glass sheet, comprising the steps of:

preparing the bottom and head support for the glass units by mounting a sill frame and a head frame to the bottom and top horizontal edges of the building opening, attaching gasket means to the first leg portions of the first and second channel members of a pair of glass units, said gasket means including a first gasket strip mounted on the first leg portions of the first channel member of each of the glass units and a second gasket strip mounted on the first leg portions of the second channel member of each of said glass units, said first and second gasket strips being arranged to contact one another along the vertical joints of side-abutting glass units to form a buttjoint and being substantially flush with the exterior glass sheets to provide a weatherseal joint along the abutting vertical edges thereof, setting one of the glass units in position on said head and sill frame and positioning the same toward the previously installed glass unit so as to compress the adjacent gasket strips together so as to form a vertical weatherseal therebetween.

18. The method according to claim 17 including the subsequent step of providing a vertical seal between the adjacent vertical edges of the second leg portions of said first and second channel members and applying a seal to the vertical channel space formed between opposed vertical edges of the interior glass sheets of said glass units so as to seal off the interior part of the abutting glass units.

* * * * *